US005207564A

United States Patent [19]

Fritchman, deceased

[11] Patent Number: 5,207,564

[45] Date of Patent: May 4, 1993

[54] COMPRESSOR HEAD AND SUCTION MUFFLER FOR HERMETIC COMPRESSOR

[75] Inventor: Jack F. Fritchman, deceased, late of Cullman, Ala., by Catherine Fritchman executrix

[73] Assignee: White Consolidated Industries, Inc., Cleveland, Ohio

[21] Appl. No.: 871,392

[22] Filed: Apr. 21, 1992

[51] Int. Cl.[5] ..... F04B 39/00

[52] U.S. Cl. ..... 417/312; 181/403; 181/229

[58] Field of Search ..... 417/312; 181/229, 403

[56] References Cited

U.S. PATENT DOCUMENTS

| | | | |
|---|---|---|---|
| Re. 33,902 | 4/1992 | Fritchman | 181/403 |
| 4,313,715 | 2/1982 | Richardson | 417/312 |
| 4,401,418 | 8/1983 | Fritchman | 417/312 |
| 4,477,229 | 10/1984 | Kropiwnicki | 417/312 |
| 4,755,108 | 7/1988 | Todescat et al. | 417/312 |
| 4,784,581 | 11/1988 | Fritchman | 417/312 |

FOREIGN PATENT DOCUMENTS

| | | | |
|---|---|---|---|
| 0195486 | 9/1986 | European Pat. Off. . | |
| 0068780 | 3/1988 | Japan | 417/312 |

*Primary Examiner*—Richard A. Bertsch
*Assistant Examiner*—Peter Korytnyk
*Attorney, Agent, or Firm*—Pearne, Gordon, McCoy & Granger

[57] ABSTRACT

A hermetic refrigeration compressor of the single reciprocating piston type as a valve plate extending over the open end of the cylinder and a first cylinder head secured to the valve plate and enclosing a discharge planum. The first cylinder head includes a recessed portion adjacent a suction port and has a bridge portion extending across the recess above the valve plate. The suction side includes an integral suction muffler and second cylinder head which fits within the recess to include a planum overlying the suction port and a U-shaped spring clip engages the bridge with one leg between the bridge and the second cylinder head to hold it in place while the clip includes a second leg which extends over the top of the bridge and hooks on the side to hold the second cylinder head and the spring clip in place.

8 Claims, 3 Drawing Sheets

COMPRESSOR HEAD AND SUCTION MUFFLER FOR HERMETIC COMPRESSOR

BACKGROUND OF THE INVENTION

This invention relates generally to hermetic refrigeration compressors of the type used in household appliances, and more particularly to suction muffler and cylinder head arrangements for such compressors, together with arrangements for expediting the assembly of such compressors.

One type of compressor used for household appliances such as refrigerators and freezers utilizes a single piston reciprocating in a cylinder and driven through a crankshaft which is connected directly to the stator of an electric motor. The compressor cylinder block and electric motor are resiliently mounted on springs within the closed steel casing, which is completely sealed except for the conduits carrying refrigerant to and from the interior of the casing. Such compressors have relatively small fractional horsepower electric motors generally operating at a speed of around 3450 rpm when operating from a 60 Hertz supply, and generally range between one-third and one-sixth horsepower. Such compressors must operate at very high efficiency and produce a minimum of noise when installed in the appliance, since such appliances are normally located in the kitchen or other frequently used room in the home.

Because of the size and operating speed of such compressors, valving to admit refrigerant to the pumping cylinder and allowing its discharge is generally in the form of reed valves formed from thin sheets of spring steel operating to cover and uncover ports extending through a valve plate which extends across the open end of the compressor. In many prior designs, the valve plate is covered by a cylinder head generally made from metal for strength which incorporates within the single cylinder head separate plenum chambers or openings for both the suction and discharge sides of the valving which is mounted directly on the valve plate.

In order to ensure quiet operation of the compressor, acoustic mufflers are provided for both the suction and discharge sides, so that the refrigerant pumped by the compressor enters the discharge plenum, from which it passes through a discharge muffler through suitable connection tubing, to the exterior of the casing. Likewise, the incoming refrigerant which may be allowed to flow freely through the interior of the casing is directed through a suction muffler, from which it passes to the suction plenum in the cylinder head.

While older compressor designs used the incoming refrigerant to cool the compressor, and therefore tried to ensure flow of the incoming refrigerant around the various portions of the compressor mechanism before it entered the suction muffler, such heating of the refrigerant results in reduced overall compressor efficiency. For this reason, modern compressor designs try to prevent all unnecessary heating of the incoming refrigerant so that it is as cool as possible when it finally enters the pumping cylinder through the suction valve.

In order to prevent this heat transfer to the incoming refrigerant on the suction side, it has been proposed to make the suction muffler of a suitable thermal insulating material such as a plastic, rather than using metal, which has a much higher thermal conductivity. Furthermore, since one of the sources of heat is the gases on the discharge side, it has been proposed to separate the cylinder head into two separate members, with the discharge plenum comprising one cylinder head and being made of metal for purposes of strength because of the high pressures within this plenum, and the suction side cylinder head forming the suction plenum can be made from a suitable plastic material and combined with portions of the suction muffler. One such arrangement is shown in the present inventor's U.S. Pat. No. 4,784,581, where the discharge cylinder head is cut away in the area around the suction port to form a V-shaped notch. The discharge cylinder head still extends to the four corners of the valve plate, where it is secured by suitable bolts at the four corners to provide the necessary structural rigidity and support for the valve plate which is clamped between the discharge cylinder head and the cylinder block. The remaining portion of the V-shaped notch overlying the suction port is covered by a plastic suction cylinder head, which is held in place by a suitable bolt extending through the valve plate into the cylinder head and made integral with at least the base portion of the suction muffler. In order to avoid an excess of clamping forces around the bolt, the bolt rests against a bracket member, which also serves to clamp in place an oil suction tube extending down in the oil reservoir in the bottom of the compressor casing. This suction tube admits a small amount of oil into the suction chamber for lubrication of the suction valve in the interior of the compressor cylinder. By spacing the suction cylinder head away from the discharge cylinder head, thermal conduction of heat to the suction plenum is minimized, and it has been found that the presence of a suction plenum as large as possible directly over the suction port ensures minimum restriction of flow of the suction gases for maximum efficiency.

Another arrangement of a plastic suction muffler adapted to make direct connection to the valve plate and suction port is shown in European Patent Publication 195,486, published Sep. 24, 1986. In this case, the compressor is provided with a metal cylinder head including a discharge chamber and defining a U-shaped slot at the suction port. A plastic suction muffler is mounted below the cylinder head and has an extension or appendage which projects into the U-shaped slot to make connection to the suction port. A specially shaped spring clip is secured over a projecting post on the suction muffler appendage, and extends vertically over the suction muffler with resilient ends to press the muffler against the valve plate. The slot has overhanging portions on the metal cylinder head and projecting ears with bent tabs on the clip slide over these overhanging portions and make frictional gripping engagement to hold the entire suction muffler assembly in place on the compressor.

SUMMARY OF THE INVENTION

The present invention provides an improved construction for a small, single-cylinder hermetic refrigeration compressor which allows more rapid and foolproof assembly by minimizing the number of threaded fasteners required in the cylinder head area. The cylinder block has an open end for the cylinder in which the piston slides, and this end is closed off by means of a metal valve plate of sufficient thickness to provide the strength to resist deflection under operating conditions. The valve plate has both suction and discharge ports, and two separate cylinder heads—one for the suction area and one for the discharge area—in combination extend over substantially all of the exposed area of the valve plate. The discharge cylinder head extends over a major portion of the area and is secured to the cylinder block by a plurality of bolts extending also through the valve plate and making threaded engagement with the cylinder block. All of these bolts, which may be four in number at the four corners of a roughly square configuration, pass through the discharge cylinder head, which, on one side between a pair of bolts, is recessed with a generally V-shaped notch to expose the area of the valve plate around the suction port. A bridge member, preferably integral with the discharge cylinder head, but which could be a separate piece, extends between two of the bolt hole areas across the notch a spaced distance away from the valve plate.

The suction cylinder head portion is preferably formed of a plastic material of low thermal conductivity, and has a portion which is configured to fit beneath the bridge on the discharge cylinder head and cover the remaining exposed portion of the valve plate around the suction port. This cylinder head includes a plenum chamber overlying the suction port and an extension portion, which is preferably integral with a portion of the suction muffler itself, so that the combination suction muffler and suction cylinder head may be preassembled as a unitary assembly prior to mounting on the compressor. To hold the suction muffler and cylinder head assembly in place, a spring clip is provided having two generally parallel extending legs joined at a U-shaped bight. The legs extend generally parallel to the valve plate and the exposed surface of the suction muffler and suction cylinder head member, with one of the legs extending between the bridge and the suction cylinder head in such a way that the bight and free end rest against the suction cylinder head, while the intermediate portion is arched to bear against the underside of the bridge to bias the suction cylinder head in place against the valve plate and a suitable sealing gasket covering the exposed portion of the valve plate. The forces holding this member in place need not be high, not only because of the relatively light weight of the thermal insulating plastic material, but also because the suction pressure within the plenum chamber in the suction cylinder head is less than the external pressure, which aids in clamping the suction cylinder head in place.

The other leg of the clip extends over the top of the bridge and has projecting ears at its free end extending toward the other leg so as to snap over the edge of the bridge to hold the clip in place, thereby preventing movement of both the suction cylinder head and the spring clip. This free end of the second leg may also be used to hold a suction oiling tube in place. Such a tube has a free end in the lubricating oil in the sump area at the bottom of the casing, and extends into the suction cylinder head plenum chamber to deliver a small controlled amount of oil into the suction port on the valve plate to provide lubrication for the suction valve and the interior of the pumping cylinder. The foregoing arrangement allows rapid assembly of the compressor cylinder head and suction muffler in place after the discharge cylinder head has been assembled by tightening the clamping bolts holding it in place. It is only necessary to place the suction muffler and suction cylinder head in position, add the oil tube if this is used, and then slide the clip in place, with the one leg extending beneath the bridge and the second leg extending over the top of the bridge, until the clip snaps in place, with the bent tabs engaging the one edge of the bridge. This allows the assembly to be done without the use of any threaded fasteners, and ensures a relatively foolproof assembly by preventing any incorrect positions or locations for the parts.

DETAILED DESCRIPTION OF THE PREFERRED EMBODIMENT

Figure 1:
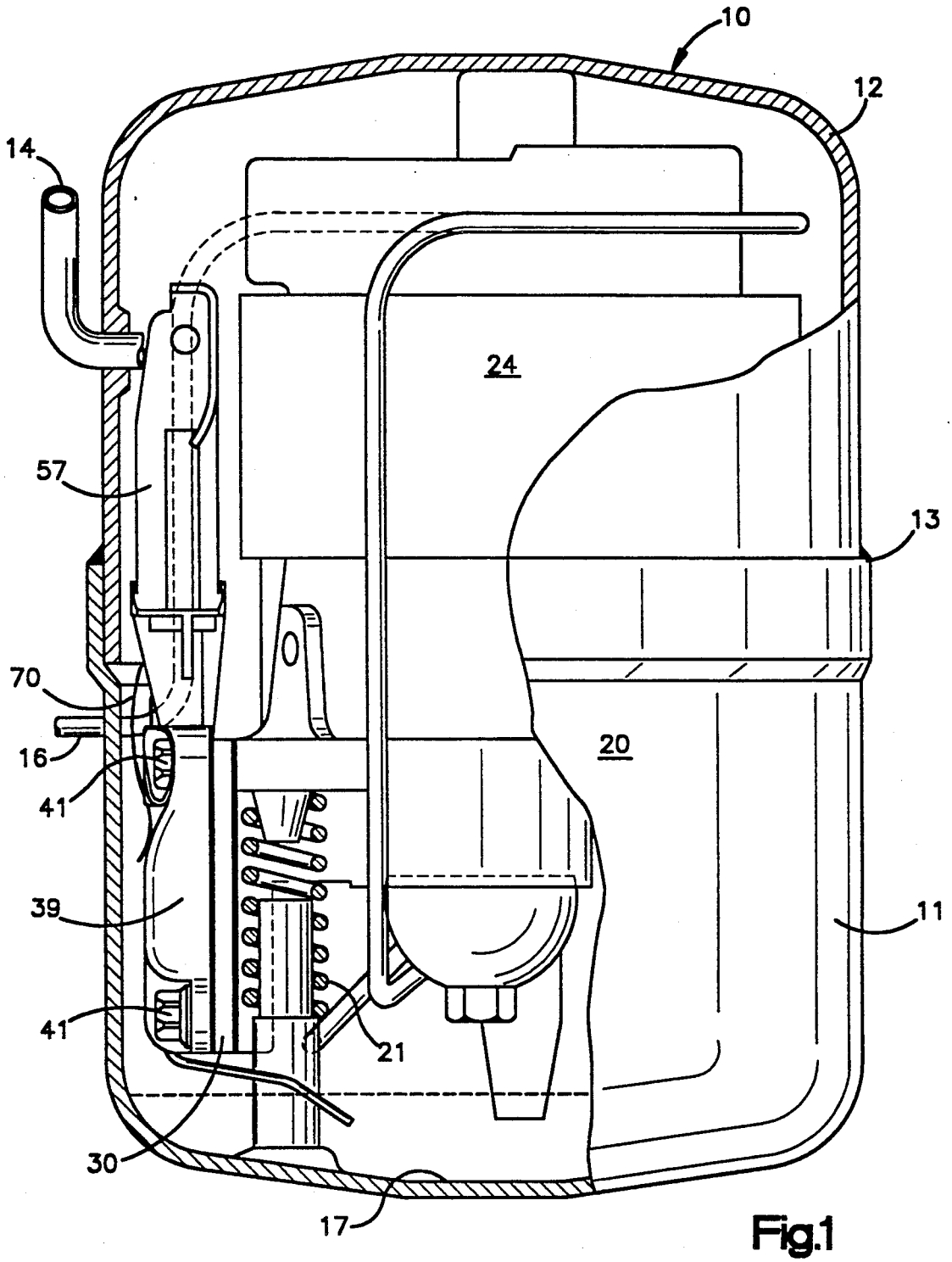
FIG. 1 is a side elevational view, partly in section, of a hermetic refrigeration compressor incorporating the present invention.

Referring now to the drawings in greater detail, as shown in FIG. 1, the hermetic refrigeration compressor includes a shell or casing 10 enclosing the rest of the compressor mechanism. The casing 10 is preferably formed from a bottom shell portion 11 and a top shell 12 joined together along a seam 13 so that the shell is completely sealed except for the suction and discharge lines 14 and 16, which allow the refrigerant to enter and leave the compressor and its internal mechanism. The bottom shell 11 is formed with an oil reservoir 17 at the bottom which is filled with a suitable charge of compressor lubricating oil to a predetermined level.

A cylinder block 20 is mounted within the shell 10 on suitable springs 21 to provide a vibration isolating mount between the shell and the cylinder block. Electric motor 24 is mounted on top of cylinder block 20, and a horizontal cylinder 26 (see FIG. 2) is formed within the cylinder block 20 to receive a piston 27, which is driven by suitable means such as a crank and connecting rod (not shown) to reciprocate the piston in the cylinder to and from the end face 28 formed on the cylinder block 20.

The open end of cylinder 26 is closed off by means of a valve plate 30 extending across the end face 28. On the inner side of the valve plate 30 adjacent the cylinder block 20 is located a thin spring steel valve sheet 31 generally coextensive with the valve plate 30, and forming the suction valve reed which seals against a suction port 33 formed in the valve plate 30. A suitable gasket 32 is positioned between the valve sheet 31 and the cylinder block end face 28 for sealing purposes. On the other side of valve plate 30 is located an outer gasket 36 which provides sealing for the cylinder heads which are adapted to fit and seal against the other or outside of valve plate 30.

Figure 2:
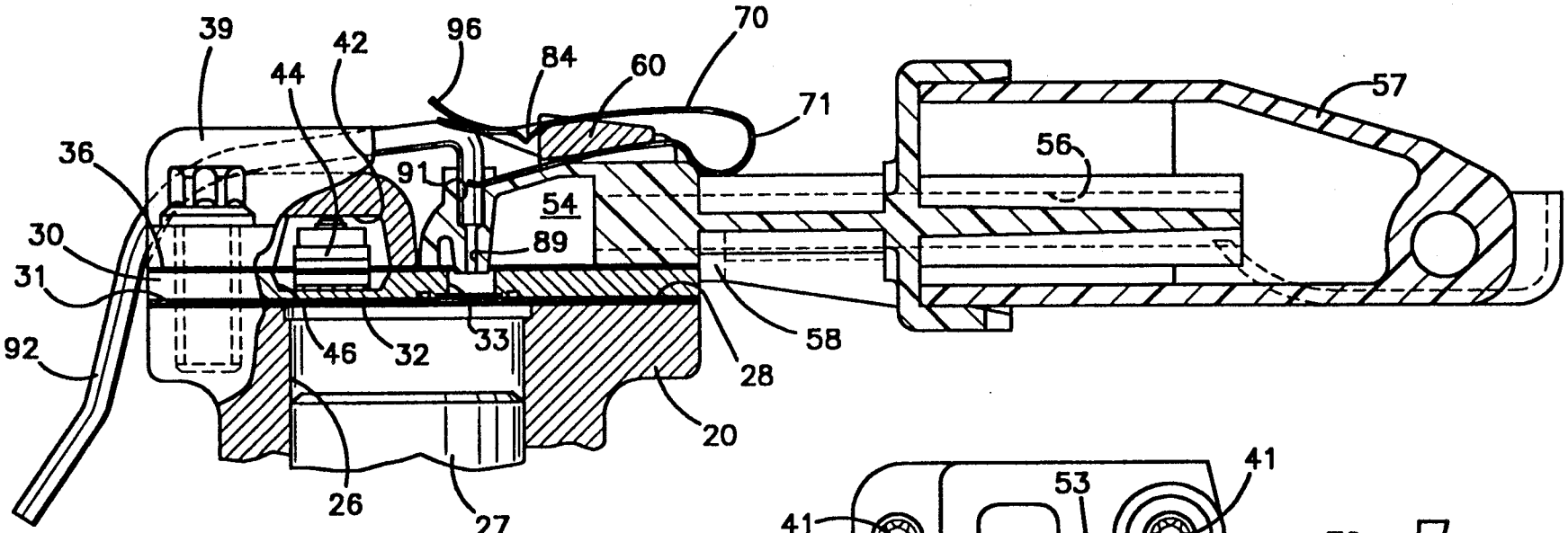
FIG. 2 is an enlarged, fragmentary, cross-sectional view of the cylinder head, suction muffler, and valve plate portion of the compressor shown in FIG. 1.
Figure 3:
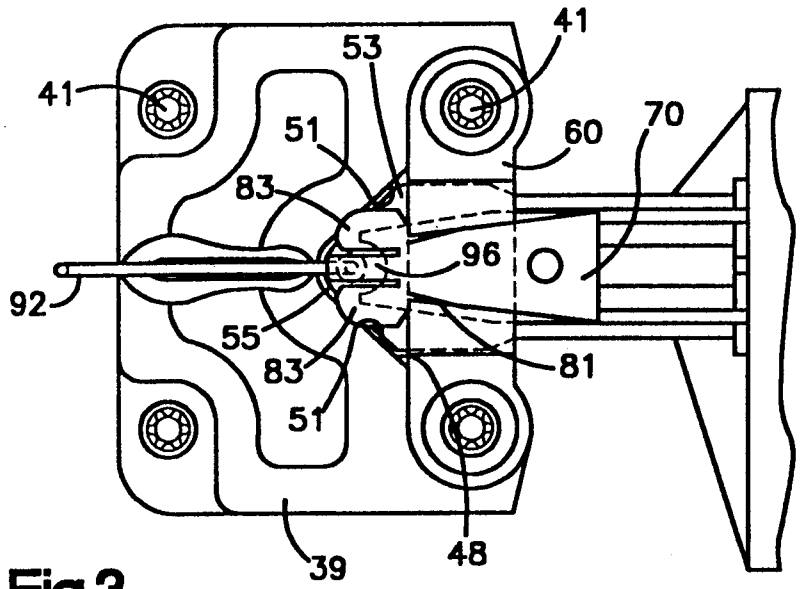
FIG. 3 is a fragmentary side elevational view of the cylinder head assembly shown in FIG. 2.
Figure 4:
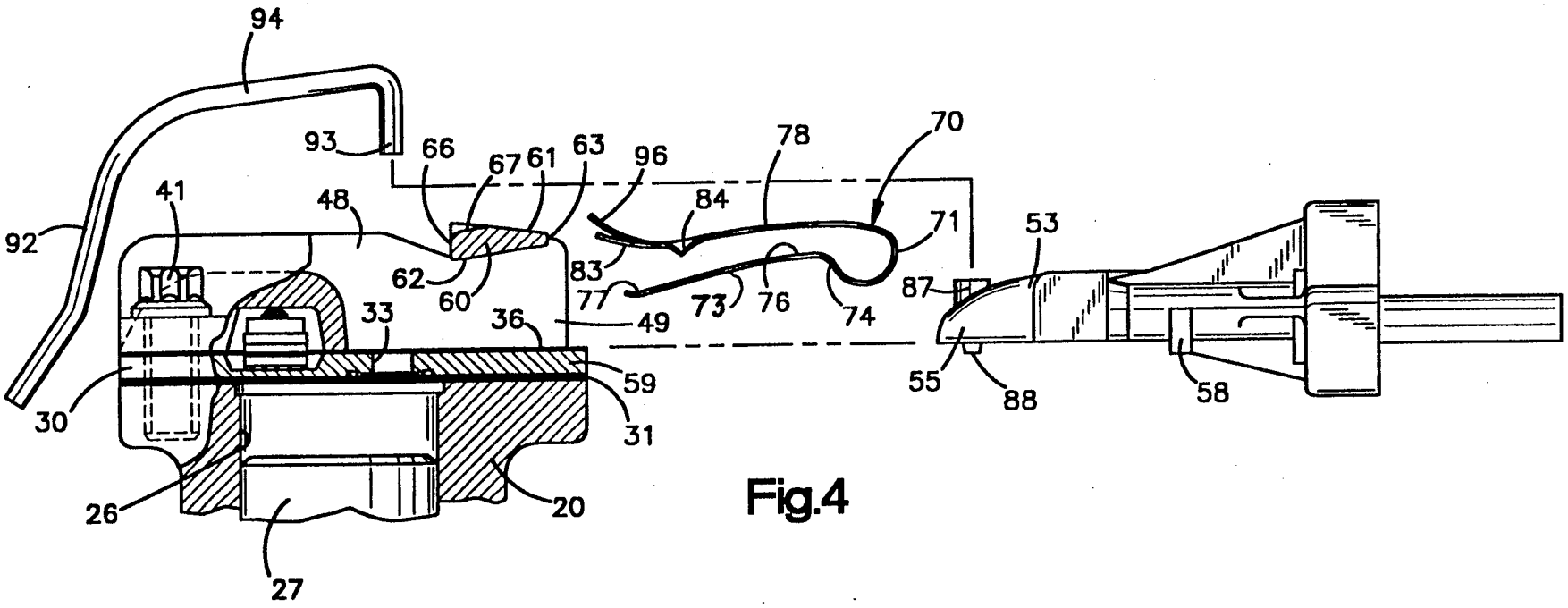
FIG. 4 is a fragmentary, exploded view of the parts shown in FIG. 2.

As shown in FIGS. 2, 3, and 4, a discharge cylinder head 39 is seated against the outer gasket 36 and held in place by suitable bolts such as the four bolts 41, which extend through the discharge cylinder head 39 at the four corners in approximately a square pattern, and threadedly engage the cylinder block 20 to firmly clamp the discharge cylinder head 39, valve plate 30, valve sheet 31, and the two gaskets 32 and 36 tightly together on the cylinder block end face 28. The discharge cylinder head 39 extends over most of the area of the valve plate 30 and defines within itself a discharge plenum 42. Within the discharge plenum 42 is a suitable discharge valve assembly 44 mounted within a recess 46 formed in the valve plate. It will be understood that the gases discharged from the cylinder 26 pass the discharge valve 44 into the discharge plenum 42, from whence they flow through suitable discharge mufflers (not shown) to the compressor discharge line 16 extending through the shell 10 to the rest of the system.

The discharge cylinder head 39 is necessarily large because of the desirability of having a maximum volume in the discharge plenum 42, and must be relatively strong because the discharge gases are necessarily at both the high pressure and temperature. This generally requires that the discharge cylinder head 39 be made of a suitable metal, such as aluminum, for purposes of strength. It also ensures that the cylinder head will dissipate a certain amount of heat to its exterior. Accordingly, it is found desirable to isolate the suction portion of the system and, because of the low pressures, it can be made of a suitable plastic material which has adequate strength but also serves as a thermal insulator to minimize the absorption of heat by suction gases.

To allow access to the suction port 33, the discharge cylinder head 39 is formed with a cut-away portion or recess 48 defined by parallel sidewall portions 49 and V-shaped walls 51 extending around the suction port 33, and a suction cylinder head 53 fits in this area and has tapered walls 55 extending parallel to walls 51 but spaced out of contact with the discharge cylinder head 39 to avoid thermal conduction. To hold the walls 55 spaced from the discharge cylinder head, cylinder head 53 has a pair of projecting lugs 58 which engage the edge 59 of the valve plate 30 to serve as stops and limit movement of the suction cylinder head in that direction. The suction cylinder head 53 defines a suction plenum 54 overlying suction port 33 (see FIG. 2) and extending away from the suction plenum 54 are one or more passages 56 extending upward into a suction muffler assembly 57. It will be understood that the suction cylinder head 53 and suction muffler 57 may be made of the same plastic thermal insulating material as a single piece and, except as described hereinafter, this one-piece assembly may be constructed in accordance with the teaching of the present inventor's aforesaid patent U.S. Pat. No. 4,784,581.

While suitable plastic materials for the suction cylinder head and suction muffler, such as fiberglass-filled polyester resin, offer excellent heat resistance and thermal insulating abilities, as well as relatively low cost of fabrication, these materials do provide a problem in holding them in place because of the tendency of the material to cold flow under high localized pressures. Thus, the use of a single screw or bolt to clamp the suction cylinder head in place has required the use of additional metallic members to spread the force over a large area to minimize the cold flow problems, and this generally increases the assembly time while also increasing the cost because of the additional parts that may be required. While the discharge cylinder head 39 requires strong fasteners because of the high pressures and large areas of the discharge plenum, the suction cylinder head 53 has an inherent tendency to stay in place because the suction at the suction port 33 causes the suction plenum 54 to be at a lower pressure than the ambient within the shell 10.

With the present invention, the suction muffler and cylinder head are easily assembled and held in place by a special spring clip. To accommodate this construction, the discharge cylinder head 39 is provided with a bridge 60 which extends transversely across the cut-away portion 48 between the parallel sidewalls 49 a spaced distance away from the valve plate 30. As shown in FIGS. 2 and 4, bridge 60, which is preferably integral with the discharge cylinder head but may be made as a separate piece held in place with the same bolts 41 that hold the discharge cylinder head in place, is essentially triangular in cross section. The bridge 60 thus has an upper surface 61 and lower surface 62 which taper away from the top or front narrow edge 63 to a bottom or wide edge 66 adjacent the intersection of the V-walls 51 and parallel sidewalls 49. The upper surface 61 is preferably formed with a notch 67 adjacent the bottom edge 66, as explained in greater detail hereinafter.

To hold the suction muffler assembly in place, a spring clip 70 is used and is of a hairpin shape, with a loop or bight portion 71 joined to a lower arm 73 and upper arm 78. The lower arm 73 includes a hook portion 74 (see FIG. 4) adjacent the bight or loop 71 and has an arched portion 76 extending away from hook portion 74 and terminating in a free end 77. When the clip is in place, the arched portion 76 bears against the lower surface 62 of bridge 60 and the lower arm 73 is deflected to apply a biasing force against the suction cylinder head 53 at both the hook portions 74 and free end 77. The hook portion 74 bears against the upper side of the suction cylinder head 53 to bias the cylinder head inward so that the lugs 58 engage the valve plate edge 59.

The upper arm 78 has tapered sides 81 adjacent the mid-point that fit within the notch 67, which is similarly tapered, as best shown in FIG. 3. At its free end, upper arm 78 has a pair of ears 83 which are upturned to slide over the bridge upper surface 61 to facilitate assembly. On each side of the ears 83 are hook portions 84 which are downturned so that when the tapered portion 81 fits within the notch 67, the hook portions 84 extend downward to abut the bottom edge 66 of the bridge to provide a positive detent holding the clip in place. Since the clip is firmly held in place with respect to the bridge 60, the hook portion 74 which extends behind the suction cylinder head 53 prevents this member and the suction muffler from being withdrawn from the clamped position against the outer gasket 36 surrounding the suction port 33.

This arrangement also can be used to hold in place an oil tube which may be used in some compressors to feed oil from the reservoir 17 into the suction port 33 for lubrication of the suction valve as well as the piston and cylinder of the compressor. Accordingly, the suction cylinder head 53 may incorporate a boss 87 having an inner tip 88 which extends into the suction port 33 and has a bore 89 of small diameter to provide a metering orifice for oil. At its outer end, bore 89 joins an enlarged counterbore 91 adapted to receive an oil tube 92 and its tip portion 93 which makes a relatively snug sealing fit within the counterbore 91. Oil tube 92 may include a bent portion 94 extending over the discharge cylinder head 39 so that a central tongue 96 formed on the end of the clip upper arm 78 between the ears 83 extends over the oil tube and clamps it in place.

It is also recognized that the bridge 60 need not extend in continuous fashion all the way across the cut-away portion 48. For example, the bridge may have a gap in the center if needed for clearance purposes, and, therefore, exist as a pair of projections, one on each side of the cut-away portion, as long as they provide sufficient support for the spring clip.

The assembly of the device is quite simple, since all of the structures except for the suction cylinder head and suction muffler, together with clip 70 and oil tube 92, are assembled in the well known manner on the cylinder block 20 and the bolts 41 tightened to hold the discharge cylinder head 39 in place. For further assembly, the suction cylinder head 53 with the attached suction muffler 57 slides into place within the cut-away portion 48 until the lugs 58 contact the valve plate edge 59, after which the oil tube 92 can be assembled by inserting the tip 93 into the counterbore 91. Then, the clip 70 slides into place, with the lower arm 73 extending beneath the bridge 60 while the upper arm 78 extends over the upper surface 61 until the hook portions 84 snap behind the bottom edge 66 in the notch 67. Once the clip is in this position, assembly is complete, and, due to the aforesaid engagement between the clip 70 and the suction cylinder head 53, these members are firmly locked together and can be disassembled only by first removing the tip 70 by prying upward on the upper arm 78 to disengage the hook portions 84 from the bridge.

Although the preferred embodiment of this invention has been shown and described in detail, it should be understood that various modifications and rearrangements of the parts may be resorted to without departing from the scope of the invention as disclosed and claimed herein.

What is claimed is:

1. A hermetic refrigeration compressor comprising a casing, a motor compressor unit mounted inside said casing and including a cylinder block having a cylinder with an open end and a piston in said cylinder, electric motor means to reciprocate said piston in said cylinder, a valve plate secured to said cylinder block and extending across said open cylinder end, said valve plate having a suction port and a discharge port spaced from each other, a first cylinder head secured to said cylinder block and covering said discharge port, said first cylinder head extending over a major portion of said valve plate and defining a recess around said suction port, said first cylinder head including a bridge portion extending over a portion of said recess a spaced distance from said valve plate, and a second cylinder head in said recess extending over said suction port, said second cylinder head being secured by a spring clip to said bridge to hold said second cylinder head in place on said valve plate, said spring clip having a first portion extending between the inner surface of said bridge and said second cylinder head to bias said second cylinder head toward said valve plate, said spring clip having a second portion extending over the outer surface of said bridge.

2. A hermetic refrigeration compressor as set forth in claim 1, wherein said spring clip biases said second cylinder head into said recess.

3. A hermetic refrigeration compressor as set forth in claim 2, wherein second cylinder head has stop means to limit inward movement of said second cylinder head into said recess.

4. A hermetic refrigeration compressor comprising a casing, a motor compressor unit mounted inside said casing and including a cylinder block having a cylinder with an open end and a piston in said cylinder, electric motor means to reciprocate said piston in said cylinder, a valve plate secured to said cylinder block and extending across said open cylinder end, said valve plate having a suction port and a discharge port spaced from each other, a first cylinder head secured to said cylinder block and covering said discharge port, said first cylinder head extending over a major portion of said valve plate and having side wall portions defining a recess around said suction port, said first cylinder head including a bridge portion extending between said sidewall portions over a portion of said recess, said bridge having an upper surface and a lower surface a spaced distance from said valve plate, and a second cylinder head in said recess extending over said suction port, means securing said second cylinder head in said recess and out of contact with said first cylinder head, said means including a hairpin shaped spring clip engaging the upper and lower surfaces of said bridge and said second cylinder head.

5. A hermetic refrigeration compressor as set forth in claim 4, including stop means on said second cylinder head and said valve plate to limit movement of said second cylinder head into said recess.

6. A hermetic refrigeration compressor as set forth in claim 5, wherein said spring clip provides a force biasing said stop means toward said valve plate.

7. A hermetic refrigeration compressor as set forth in claim 4, wherein said spring clip has a first arm extending between the inner surface of said bridge and said second cylinder head to bias said second cylinder head toward said valve plate.

8. A hermetic refrigeration compressor as set forth in claim 7, wherein said second spring clip has a second arm extending over the outer surface of said bridge and engaging the edge of said bridge adjacent said first cylinder head.

* * * * *